US006761052B2

(12) United States Patent
Buschmann

(10) Patent No.: US 6,761,052 B2
(45) Date of Patent: Jul. 13, 2004

(54) DEVICE COMPRISING A MOMENTARY CONTACT SWITCH FOR ACTUATING A LOCK ON A DOOR OR HINGED LID, IN PARTICULAR, FOR A VEHICLE

(75) Inventor: Gerd Buschmann, Velbert (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 10/362,948

(22) PCT Filed: Aug. 17, 2001

(86) PCT No.: PCT/EP01/09485

§ 371 (c)(1),
(2), (4) Date: Feb. 26, 2003

(87) PCT Pub. No.: WO02/27124

PCT Pub. Date: Apr. 4, 2002

(65) Prior Publication Data

US 2003/0172695 A1 Sep. 18, 2003

(30) Foreign Application Priority Data

Sep. 21, 2000 (DE) ..... 100 47 090

(51) Int. Cl.[7] ..... E05B 29/04

(52) U.S. Cl. ..... 70/361; 70/387; 70/492; 70/495; 292/DIG. 37

(58) Field of Search ..... 70/495, 496, 360, 70/361, 387, 256, 492; 292/DIG. 37

(56) References Cited

U.S. PATENT DOCUMENTS 2,437,299 A * 3/1948 Jacobi
2,454,926 A * 11/1948 Jacobi
2,683,978 A * 7/1954 Jacobi
2,866,343 A * 12/1958 Kovacs
4,223,940 A * 9/1980 Janz et al. ..... 296/37.12
4,306,431 A * 12/1981 Craig ..... 70/79
4,905,487 A * 3/1990 Morikawa et al. ..... 70/186
5,308,126 A * 5/1994 Weger, Jr. et al. ..... 292/53
5,771,723 A * 6/1998 Itoh ..... 70/360
6,231,091 B1 * 5/2001 Gleason et al. ..... 292/34

FOREIGN PATENT DOCUMENTS

DE 1428507 * 7/1964 ..... 70/496
DE 2435148 2/1976
DE 197 46 381 C1 1/1999
FR 1279704 11/1961
FR 2690193 10/1993

* cited by examiner

*Primary Examiner*—Lloyd A. Gall
(74) *Attorney, Agent, or Firm*—Friedrich Kueffner

(57) ABSTRACT

A device for actuating a lock on a door or hinged lid, particularly for a vehicle, includes a momentary contact switch and a lock cylinder having tumblers which are transferred between a blocked position and an unblocked position by a key. In the locked position, the tumblers interact with a locking edge which is released only in the unblocked position. The travelling motion of the momentary contact switch is transferred to an entry element of the lock only in the unblocked position. The lock cylinder is arranged in a manner that prevents it from twisting, and the blocking edge is configured to move transversely in relation to the tumblers. This transverse motion is caused by the traveling motion of the momentary contact switch. The blocked position of the tumblers prevents the transverse movement of the blocking edge. The traveling motion of the momentary contact switch is then only transferred to the lock when the transverse motion of the blocking edge is possible.

31 Claims, 10 Drawing Sheets

DEVICE COMPRISING A MOMENTARY CONTACT SWITCH FOR ACTUATING A LOCK ON A DOOR OR HINGED LID, IN PARTICULAR, FOR A VEHICLE

BACKGROUND OF THE INVENTION

1. Field of the Invention

The invention pertains to a device for actuating a lock on a door or hinged lid. The lock is actuated by a manually toggled push button, which in certain situations acts on the input element of the lock, which is mounted on the door. In addition, the device has a lock cylinder, which can be actuated by a key assigned to it. By means of the key, the tumblers in the lock cylinder are moved from their normal blocking position into a release position. In the blocking position, the tumblers project out from the lock cylinder and interact with a blocking edge, which is essentially parallel to an axial plane passing through the axis of the lock cylinder. In the blocked position, the toggling motion of the push button is not transmitted to the input element of the lock. This transmission cannot occur until after the key has brought the tumblers into their release position and as a result are no longer able to interact with the blocking edge.

2. Description of the Related Art

In the known device of this type (DE 197 46 381 C1), the lock cylinder itself is the toggled push button. The lock cylinder consists in this case of a cylinder core, which holds the tumblers, and a cylinder guide, in which the core can be rotated by means of the correct, inserted key. The cylinder guide has at least one blocking channel, the lateral flanks of which serve as the blocking edges. After the key has been removed, the tumblers projecting from the cylinder core are supported on the blocking edges and therefore prevent the cylinder from rotating. In this known device, the blocking edge is stationary, whereas the tumblers can be rotated relative to the edge by the rotation of the cylinder core. So that the toggling movement of the lock cylinder can act successfully on the lock, the key, which has been inserted into the cylinder core, must first rotate the cylinder core with respect to the cylinder guide. If the key is not rotated, the toggling movement of the known lock cylinder has no effect, and the toggling motion is not transmitted to the input element of the lock, located behind the lock cylinder.

The user of the known device must therefore understand the sequence in which the actuations must be performed, namely, the rotation of the key and the pushing-in of the lock cylinder, which acts as the push button, and perform them in the proper order. In addition, relatively complicated components are required, which allow the toggling movement of the known lock cylinder to be transmitted when the tumblers are in the release position, but which, when the tumblers are in the blocking position, either block such transmission or simply allow the cooperating components in question to move freely without effect.

In a device of a different type, in which the tumblers do not interact with a blocking edge located laterally next to them (DE 199 27 500 A1), it is known that a lock cylinder can be installed nonrotatably in a cylinder guide. In the normal situation, the lock cylinder is prevented from being toggled. But after the key has been inserted, a linear toggling movement is possible, as a result of which the door is unlocked. Lateral blocking edges do not scan the tumblers.

SUMMARY OF THE INVENTION

The invention is based on the task of developing a reliable device of the type mentioned above which avoids the disadvantages indicated above. This is accomplished according to the invention by the measures indicated in the characterizing, clause of claim 1, to which the following special meaning attaches:

In the invention, the lock cylinder does not have to be turned by the key. It is sufficient for the correct key merely to be inserted, as a result of which the tumblers in the lock cylinder are moved out of their normal blocking position and into their release position. For this reason, the lock cylinder in the device according to the invention is installed so that it cannot rotate. In the invention, however, the blocking edge is free to move. The toggling movement of the push button is converted into a transverse movement of the blocking edge, which is oriented crosswise to an axial plane passing through the lock cylinder. This blocking edge scans the lock cylinder to determine whether or not at least one of the tumblers is still projecting or whether, as a result of the insertion of the correct key, all of the tumblers have been pulled back. That is, the presence of only a single tumbler in the blocking position is enough to prevent the transverse movement of the blocking edge. The input element of the lock is moved in the opposite direction exclusively by the transverse movement of the blocking edge. If this transverse movement does not occur, no force is exerted on the input element of the lock, and the lock is not actuated. No additional components are needed to make the toggling movement of the push button with respect to the lock effective or ineffective. The design of the invention is thus very simple.

The invention can be realized in various ways, and specific advantages are associated with each embodiment. The blocking edge can be part of a pivotably supported pivoting element, of a transverse thrust element, or of a combination element, which can both pivot and slide. These measures are explained in greater detail in the subclaims, in the drawings, and in the description. The drawings illustrate the invention schematically on the basis of several exemplary embodiments:

DETAILED DESCRIPTION OF THE PREFERRED EMBODIMENTS

Figure 3A:
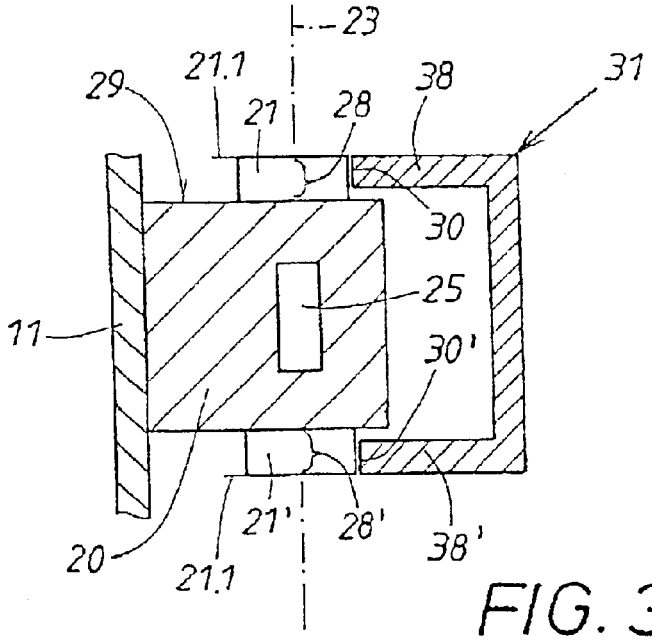
FIG. 3*a* shows a cross section through the device of FIG. 1 along the line III—III of FIG. 1, where the other components lying on other planes have been omitted.
Figure 3B:
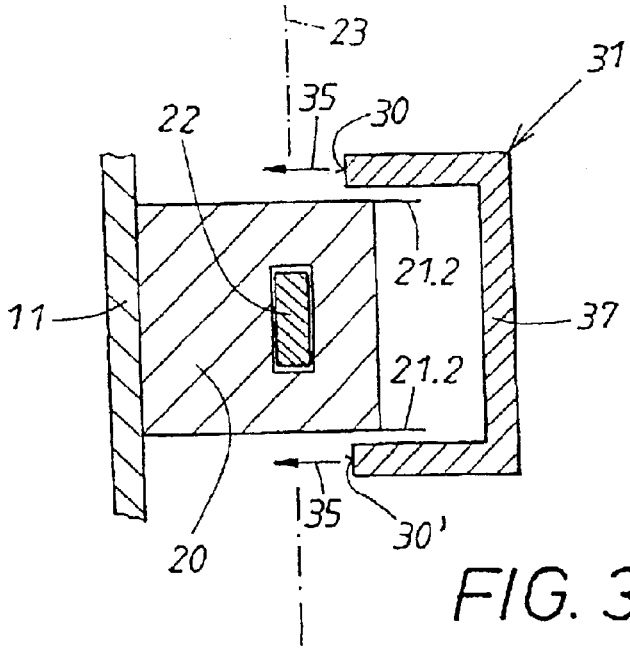
FIG. 3*b* shows a cross section, corresponding to that of FIG. 3*a*, through the device after the key has been inserted.

In the exemplary embodiment shown, the input element 40 of a lock (not shown in detail) is designed as a so-called "Bowden cable". This Bowden cable 40 comprises a jacket 41, which is permanently connected to a carrier 16, which also advantageously has an axial guide 17 for a push button. Inside the Bowden jacket 40 there is a flexible core, which is hinged to the working end of a working arm 45 according to FIG. 1 or to a reversing lever 57 of the device shown in FIG. 4*a* or FIG. 6*a*. In the former case, i.e., in the case of the device 10.1, the working arm 45 is connected nonrotatably to a pivoting element 31, which has a blocking edge 30 with which it scans the tumblers 21, 21' of a lock cylinder 20. For this purpose, as FIGS. 3*a* and 3*b* show, the pivoting element 31 is provided with a C-shaped profile 37, the two blocking edges 30, 30' being provided on the two sidepieces 38, 38' of the C. The tumblers 21 are arranged in a row 23, which simultaneously determines the axial plane through the lock cylinder 20.

Figure 1:
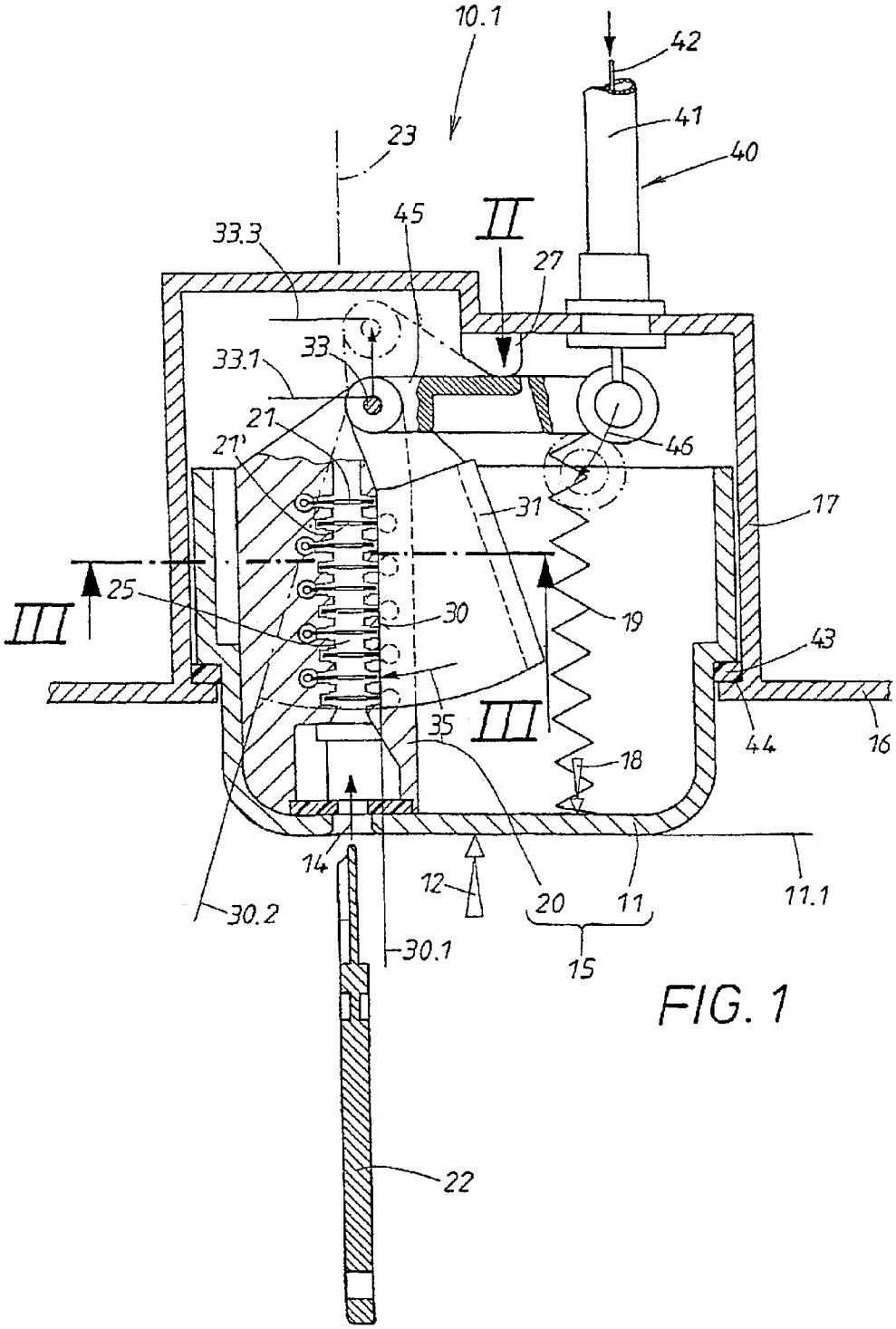
FIG. 1 shows a partial longitudinal cross section through a first embodiment of the device according to the invention in its rest position, after the key has been removed.
Figure 2:
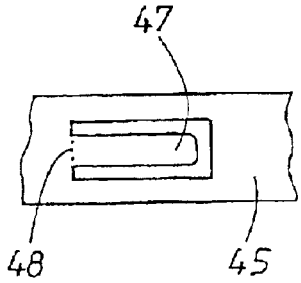
FIG. 2 show a detail of the device, seen from above, namely, from the perspective of the arrow II of FIG. 1.

So that, in the first exemplary embodiment of the device 10.1 of FIG. 1, the lock is not destroyed after the key has been removed or the wrong key inserted by attempts to forcibly actuate 12 the push button 11 or the actuating unit 15 obtained by installing the lock cylinder 20, a predetermined breaking point 48, shown in FIG. 2, is provided on the working arm 45. This point is created by a thin, tongue-shaped support point 47. When force is applied, therefore, the tongue-shaped support point 47 will break. The tumblers 21, 21' in the blocking position 21.1 according to FIG. 3*a* are thus protected from damage.

In the case of the device 10.1 of FIG. 1, the actuating unit 15 is under the force of a restoring spring 19, which is supported at the other end on the working arm 45 and thus keeps this arm in the starting position according to FIG. 1. The primary role of the restoring spring 19, however, is to produce a restoring force 18 on the actuating unit 15. End stops 43, 44, possibly with a layer of elastomeric material between them, ensure that the push button 11 to be actuated assumes a defined resting position 11.1 with respect to the carrier 16.

Figure 4A:
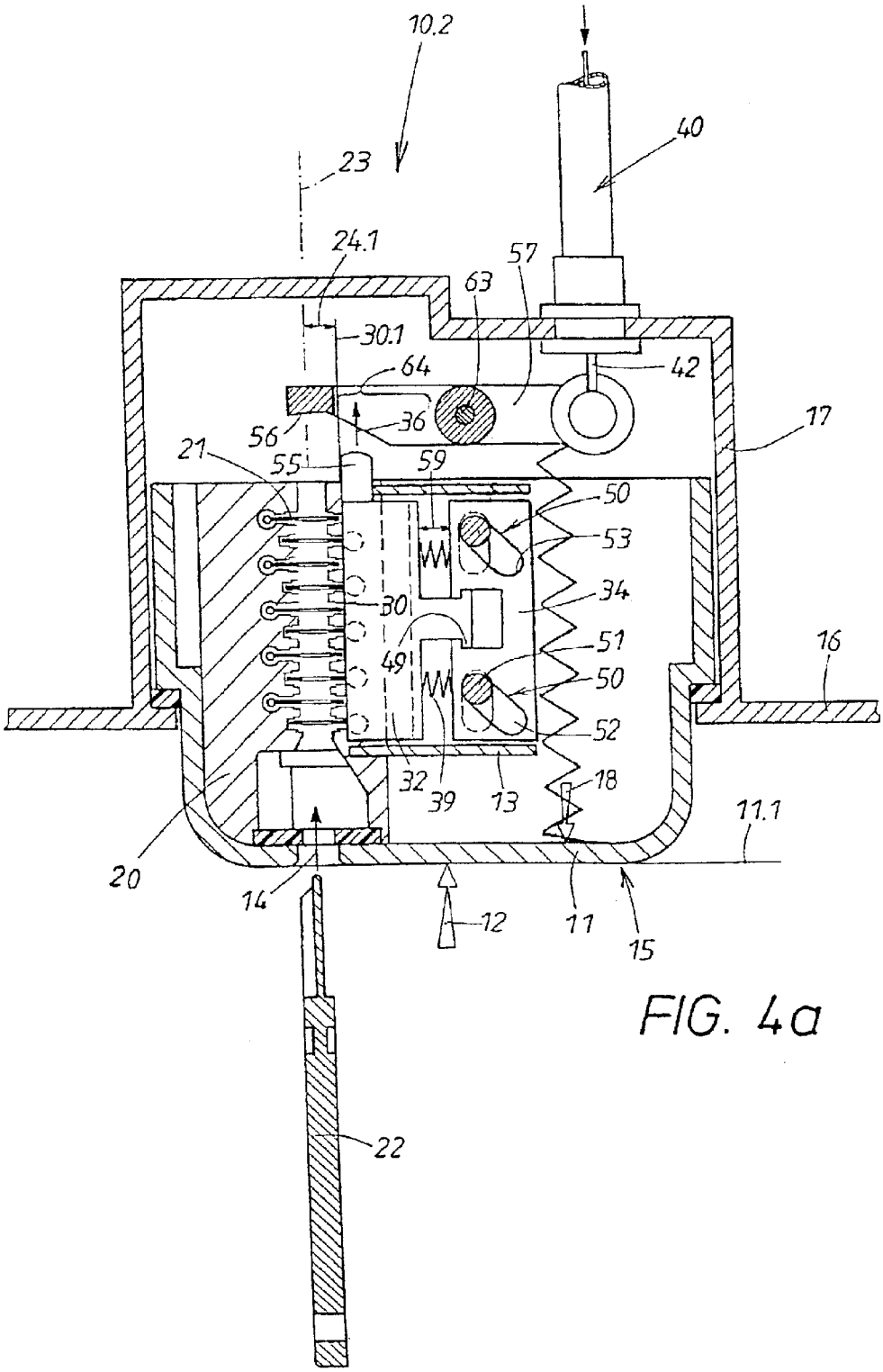
FIG. 4*a* shows an axial cross section corresponding to FIG. 1 through a second embodiment of the device according to the invention after the key has been removed.
Figure 4B:
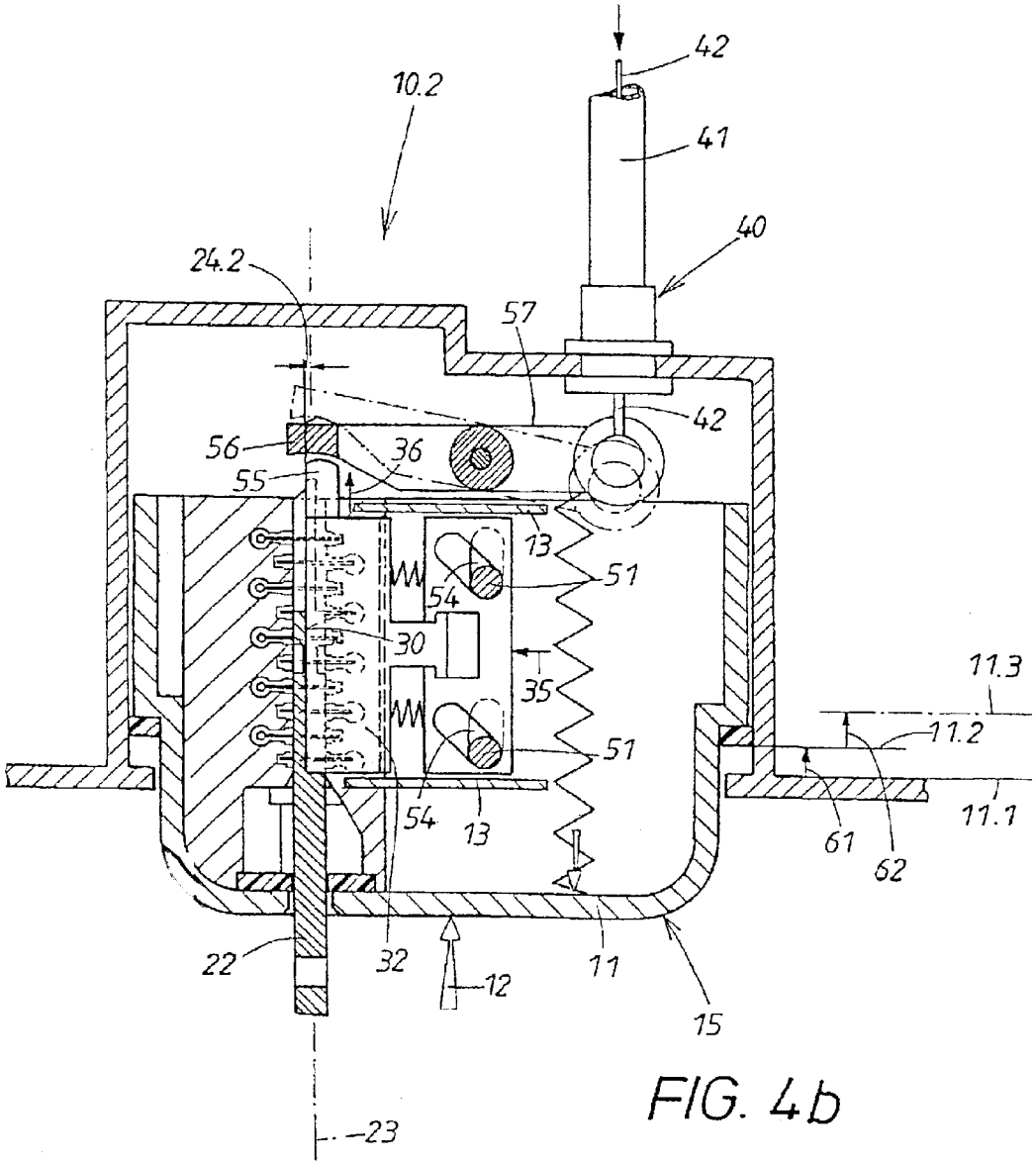
FIG. 4*b* shows the device according to FIG. 4*a* after the key has been inserted and the associated push button has assumed an intermediate toggle position according to the invention, where some of the components are indicated in broken line in their end positions after completion of the toggling motion.
Figure 5:
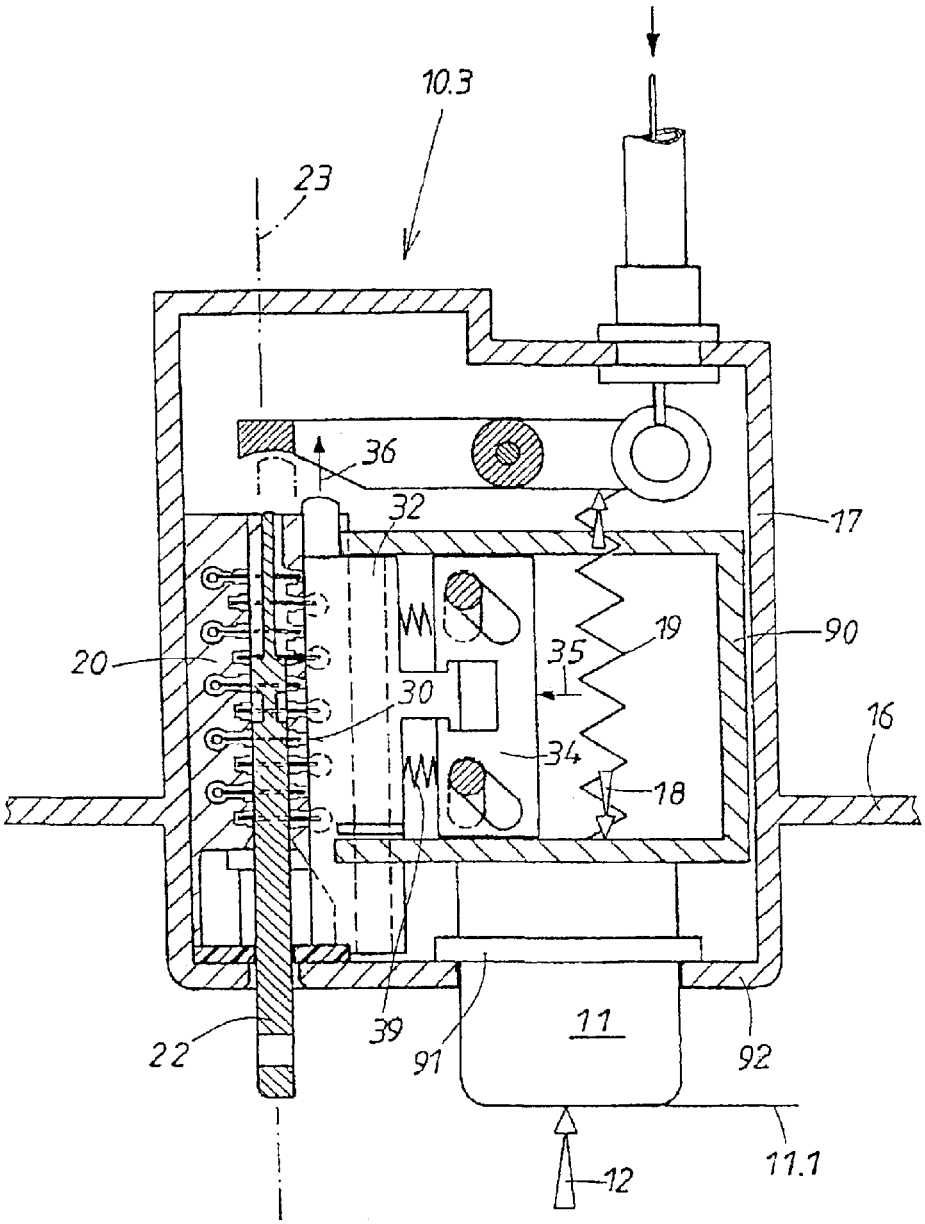
FIG. 5 shows a third exemplary embodiment of the invention, after the key has been inserted but while the device is still in its rest position.

A more careful scanning of the release position of the tumblers is obtained in the second and third exemplary embodiments according to devices 10.2 and 10.3 of FIGS. 4*a* and 5. Here the blocking edges 30 and/or the additonal blocking edges 30'(not shown in detail) are located on a thrust element 32, which is able at first to move transversely inside the actuating unit 15 of FIG. 4*a* or inside the push button 11 of FIG. 5. This is done by means of a link guide 50 in an adjacent control slide 34. This link guide 50 is provided in duplicate and consists of two slit-like, slanted guide parts 52 in the control slide 34 and of two stationary slide parts 51, which are anchored in the carrier 16 or in the axial guide 17. To allow the toggling movement 12, therefore, the push button 11 has longitudinal slots 54, shown in FIG. 4*b*, for the slide parts 51. The tumblers 21 are scanned very reliably and yet carefully. It is obvious that, here, too, the thrust element 32 has a U-shaped profile 37 similar to that of the thrust element 31 of FIGS. 3*a* and 3*b*.

FIG. 4*a* shows the position before the key 22 has been inserted. Now the blocking edge 30 is approximately parallel to the axial plane 23 and separated from it by a distance 24.1. The transverse load springs 39, in conjunction with an end stop 49 between the two parts 32, 34, ensure that these components 32, 34 are at the maximum distance 59 from each other when in the rest position 11.1 of FIG. 4*a*. Here, too, a restoring spring 19 provides a restoring force 18 on the actuating unit 15. When pressure 12 is exerted on the push button 11, the contact point 55 belonging to the thrust element does not strike the corresponding opposing contact point 56 of the associated transfer lever 57 but rather travels with no effect into a free space 64 in this lever 57. The elastic transverse loads 39 acting between the thrust element 32 and the control slide 34 are minimal and do not impair the projecting tumblers 21. The toggling movement 12 is transmitted via guide strips 13 from the toggle part 11 to the slide 32.

According to FIG. 4*b*, after the key has been inserted, it is possible for the slide 32, during an initial phase 61 of its movement, to travel freely across the retracted tumblers 21 and for its contact point 55 to line up axially with the opposing contact point 56 of the transfer cable 57. In the intermediate position 11.2 of FIG. 4*b*, the distance 24.2 between the blocking edge 30 and the axial plane 23 has been reduced to practically zero. During the remaining phase 62 of the movement noted in FIG. 4*b*, a displacement 36 occurs exclusively in a plane parallel to the axial plane. In the completely pushed-in position 11.3 of the actuating unit 15 of FIG. 4*b*, finally, the transfer lever 57 present there arrives in the end pivot position illustrated in broken line, in which the lock in the door has been opened via the core 42 of the Bowden cable 40.

The third exemplary embodiment 10.3 of FIG. 5 differs from that in FIG. 4*a* in that the lock cylinder 20 is not connected as in FIG. 4*a* to the push button 11 to form a structural unit 15 but rather is seated permanently in the carrier 17. The thrust element 32, the control slide 34, and the transverse load springs 39 situated between them are seated in a cradle 90, which is mounted in the axial guide 17 with freedom to move longitudinally in the direction of the toggling movement arrow 12 shown there. A push button 11 is permanently connected to the cradle 90, and thus the two components execute the toggling movement together. The cradle 90 is under the restoring force 18 of a restoring spring 19. The pushed-out position 11.1 of the push button 11 in front of the axial guide 17 is determined by the stop effect of a flange 91 or the like, which can, for example, cooperate with the inside surface of the front wall 92 of the housing. Otherwise, the way in which the device 10.3 functions is the same as that of the previously described device 10.2 according to FIGS. 4*a* and 4*b*.

Figure 6A:
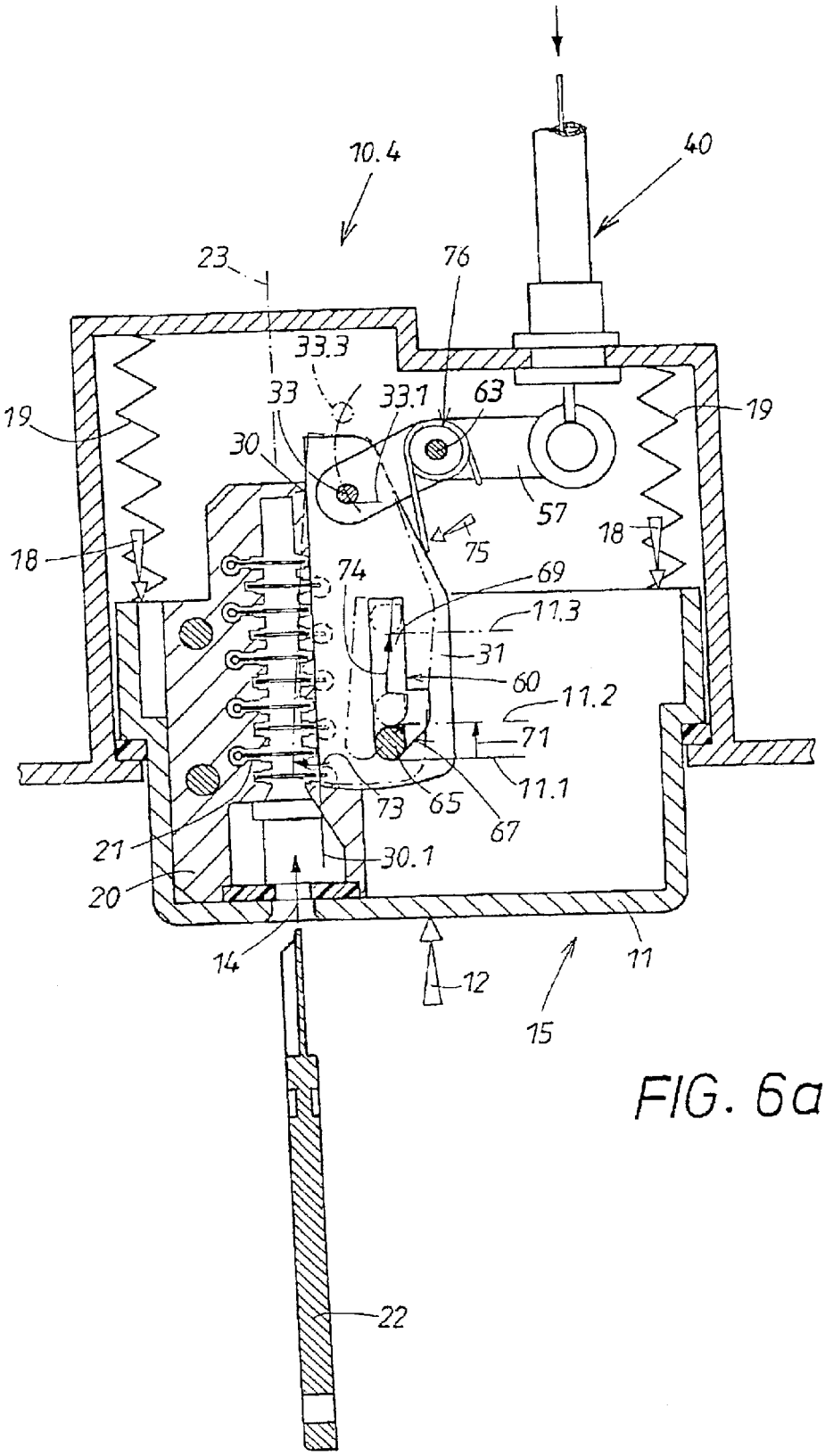
FIG. 6*a* shows a view corresponding to that of FIG. 5 of a fourth exemplary embodiment of the invention in the rest position after the key has been inserted.
Figure 6B:
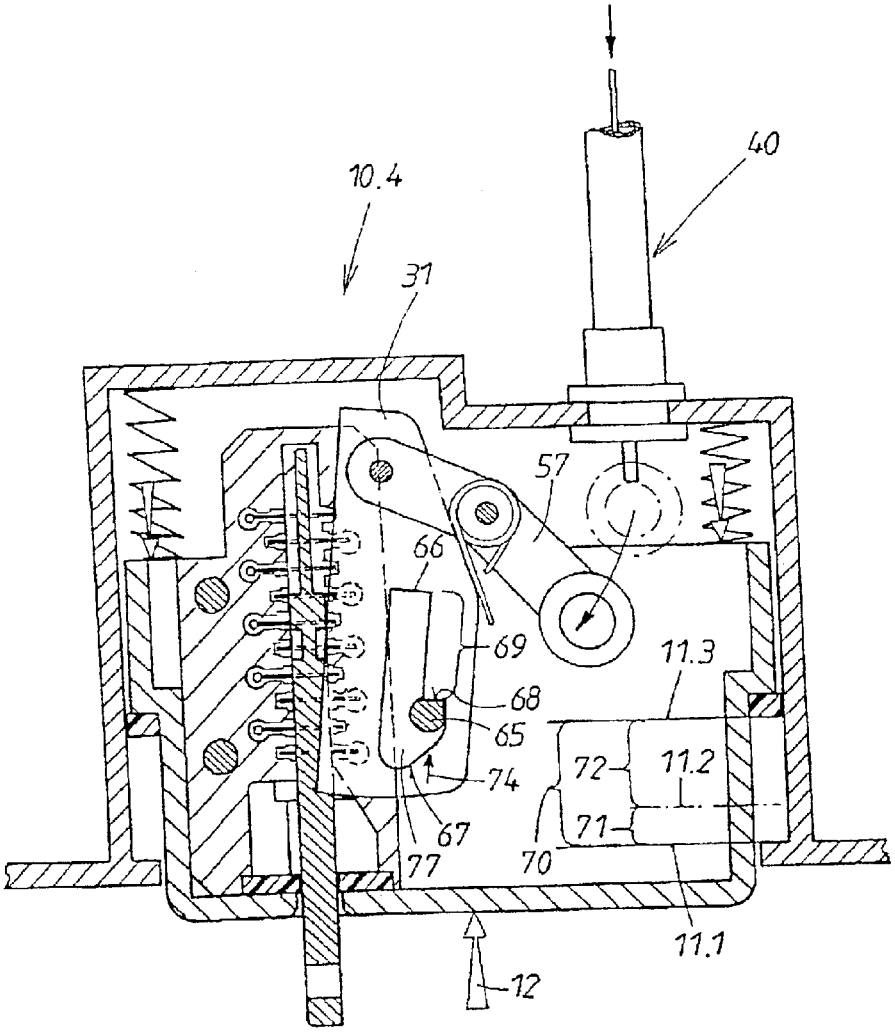
FIG. 6*b* shows the device according to FIG. 6*a* in its rest position upon completion of the toggling movement.

In the case of the fourth device 10.4 of FIGS. 6*a* and 6*b*, the blocking edge 30 is again on a pivoting element 31, which is hinged at 33 to one end of a transfer lever 57. The transfer lever 57 is mounted permanently at 63 in the housing, and its other arm acts on the input element 40 of the lock, the input element being designed here again as a Bowden cable 40. The pivoting element 31 has special guide means 60. These consist in the present case of a control pin 65, which moves along with the actuating unit 15, and of a profiled pin guide 66 in the pivoting element 31. The pivoting element 31 is under the action of an elastic load 75. For this purpose, a sidepiece spring is used in the present case, one of the sidepieces of which tries to keep the blocking edge 30 of the pivoting element 31 pressed against the tumblers 21, which are projecting outward are thus in the blocking position. In the absence of the key 22, the starting position of the pivot element 31, shown in solid line in FIG. 6*a*, is present. When in this case the push button 11 is actuated in the direction of the arrow 12 of FIG. 6*a*, the pivoting element 31 is not carried along. Although the actuating unit 15 moves along with the control pin 65 present in it in the direction of the arrow 74 in FIG. 6*a*, the control pin arrives in a free-travel section 69 of the control curve 67. During the axial movement of the lock cylinder 20, which is carried along also, the projecting tumblers 21 slide along the blocking edge 30 of the resting actuating element 31. The pivoting element 31 thus remains without effect. The pivoting element 31 hinged to the overload lever 57 remains at rest, and the lock is not actuated.

When, proceeding from FIG. 6*a*, the tumblers 21 have arrived in their release position as a result of the insertion of the correct key 22, the blocking edge 30 of the pivot element 31 is free of the tumblers 21. Then the pivoting element 31 can, under the action of the previously mentioned spring-loading force 75, pivot in the direction of the arrow 73 into the pivot position indicated in dash-dot line. Then the control curve 67 also arrives in the pivot position illustrated in dash-dot line in FIG. 6*a* and is located above the retracted tumblers 21. Then, however, a driver shoulder 68, as can be seen in FIG. 6*b*, has also arrived in axial alignment with the control pin 65, shown there in solid line. When the unit 15 is actuated in the direction of the arrow 12, after an initial phase of the toggling movement indicated by the arrow 71 and an intermediate position 11.2 has been reached, the control pin 65 arrives in the position indicated in dash-dot line, where it comes into contact with the driver shoulder 68. During the remaining phase 72, which then follows, of the total toggling movement 70 shown in FIG. 6*b*, the pivoting element 31 continues to move 74 in an essentially axial direction. The transfer lever 57 is pivoted against the action of the sidepiece spring into the working position shown in FIG. 6*b* and carries the connection point of the Bowden cable 40 along with it. The lock is actuated.

Figure 7:
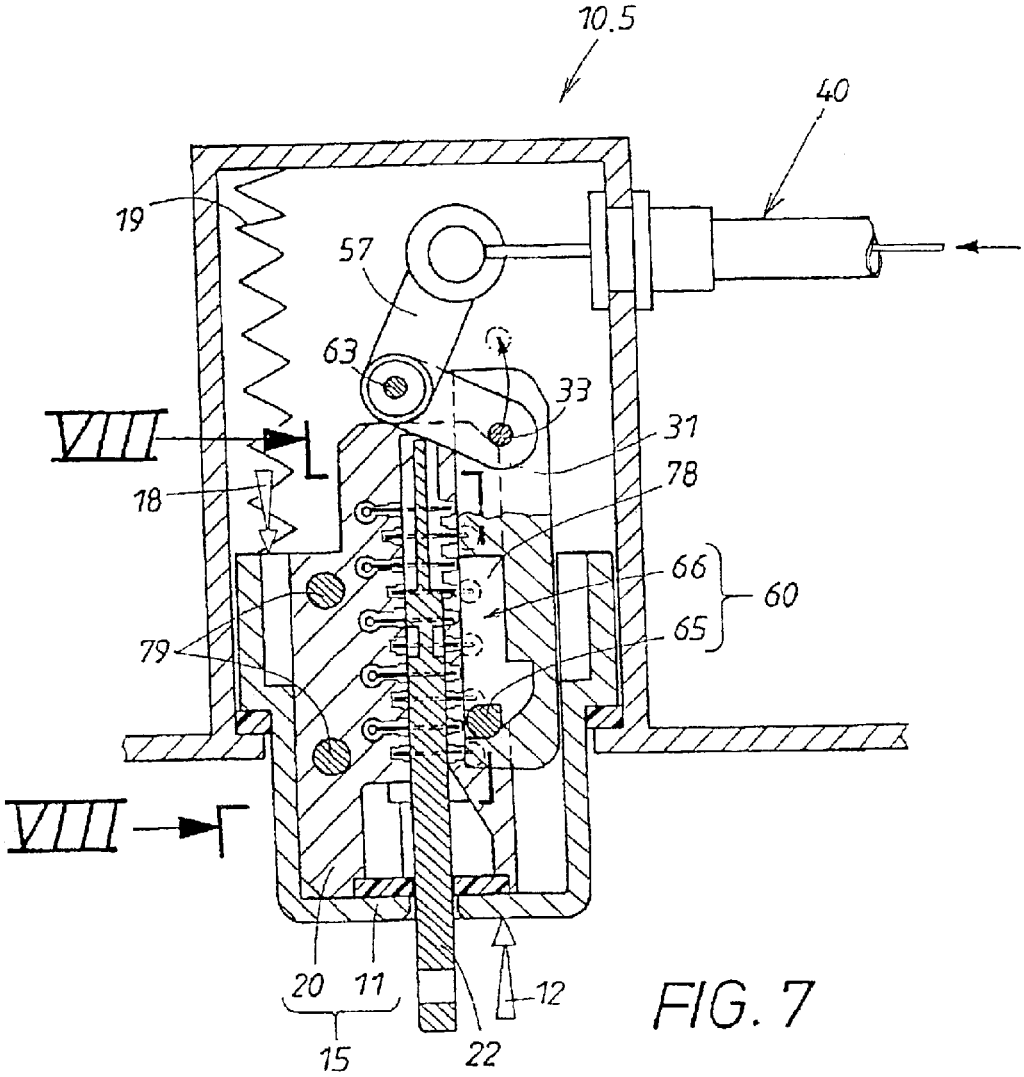
FIG. 7 show a fifth exemplary embodiment of the invention with the push button in its original rest position, which is defined by the force of a spring and end stops, where the position which one of the components occupies after the button has been pushed-in is indicated in broken line, and where the course of the cross section of FIG. 7 is indicated by the line VII—VII in FIG. 8.
Figure 8:
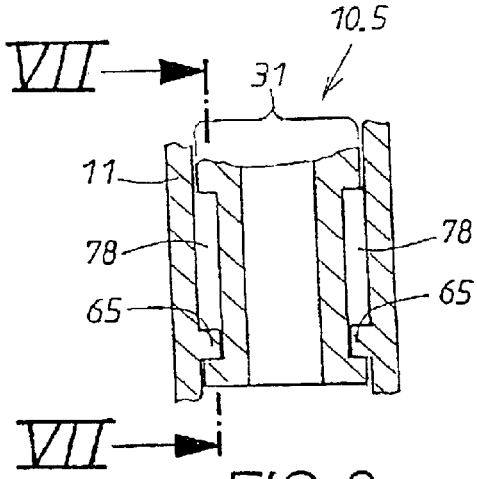
FIG. 8 shows a cross section along line VIII—VIII of FIG. 7 through a part of the device shown in FIG. 7.

Whereas the pin guide 66 is designed as an opening 77 in the pivoting element 31 in the case of the device 10.4 according to FIG. 6*b*, the pin guide is designed as a groove 78 made in the pivoting element 31 in the case of the fifth device 10.5 according to FIG. 7. This groove 78 has a profile similar to that of the opening 77, for which reason the effects are the same as those which occur in the case of the device 10.4. In the case of the device 10.5 of FIG. 7, the transfer lever 57 is designed as an angle lever, for which reason the input element 40 of the lock can assume a different angular position than it can in the device 10.4. By means of fastening means 79 such as rivets, the lock cylinder 20 is connected to the push button 11 to form a common actuating unit 15. As can be seen from the offset cross section of FIG. 8, the control pins 65 consist of two opposing parts, between which the pivoting element 31, designed here as a hollow body, is located. The control element 31 in FIG. 8 has two opposing pairs of grooves to correspond with the component pieces 65 of the control pin.

Figure 9:
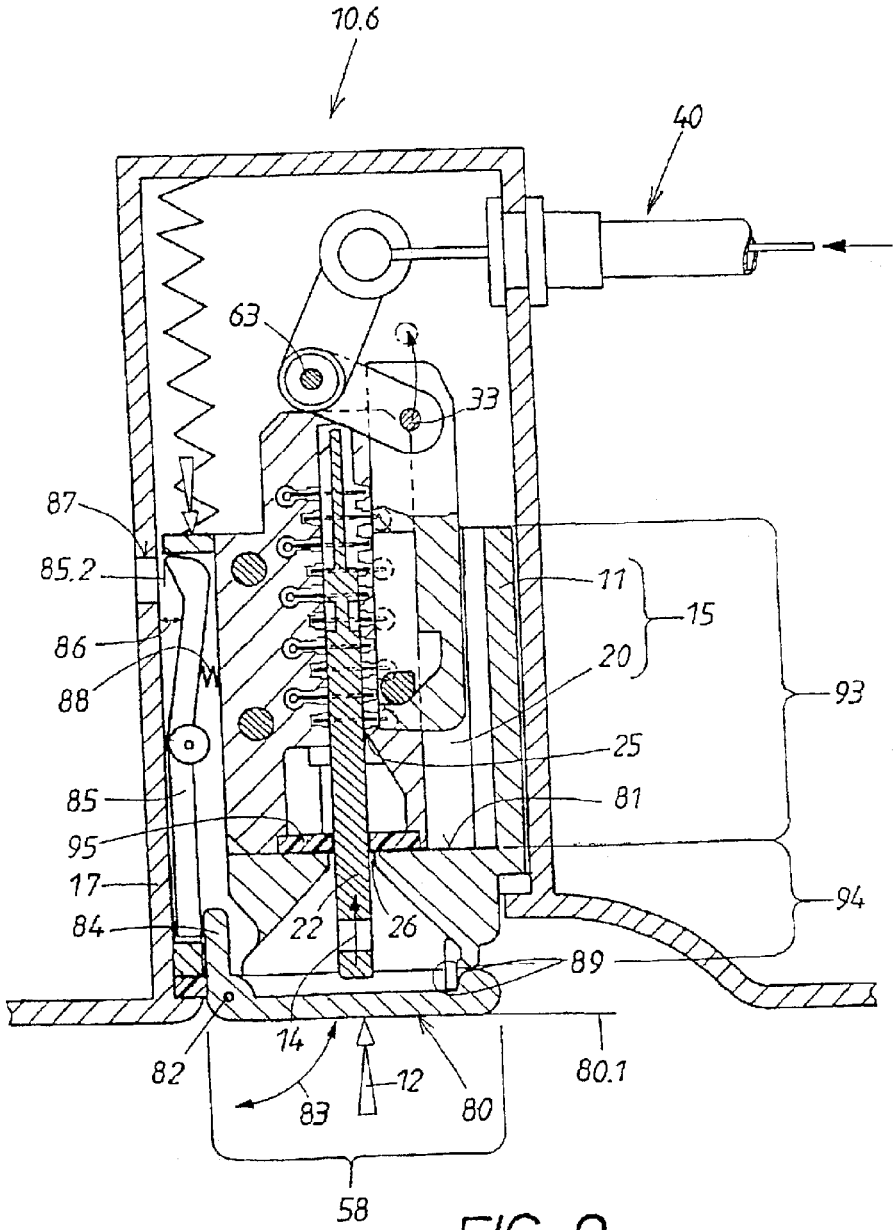
FIG. 9 shows a modification of the device according to FIG. 7, thus representing a sixth exemplary embodiment of the device according to the invention, in the rest position, where a component, namely, a hinged cover, is in its closed position.
Figure 10:
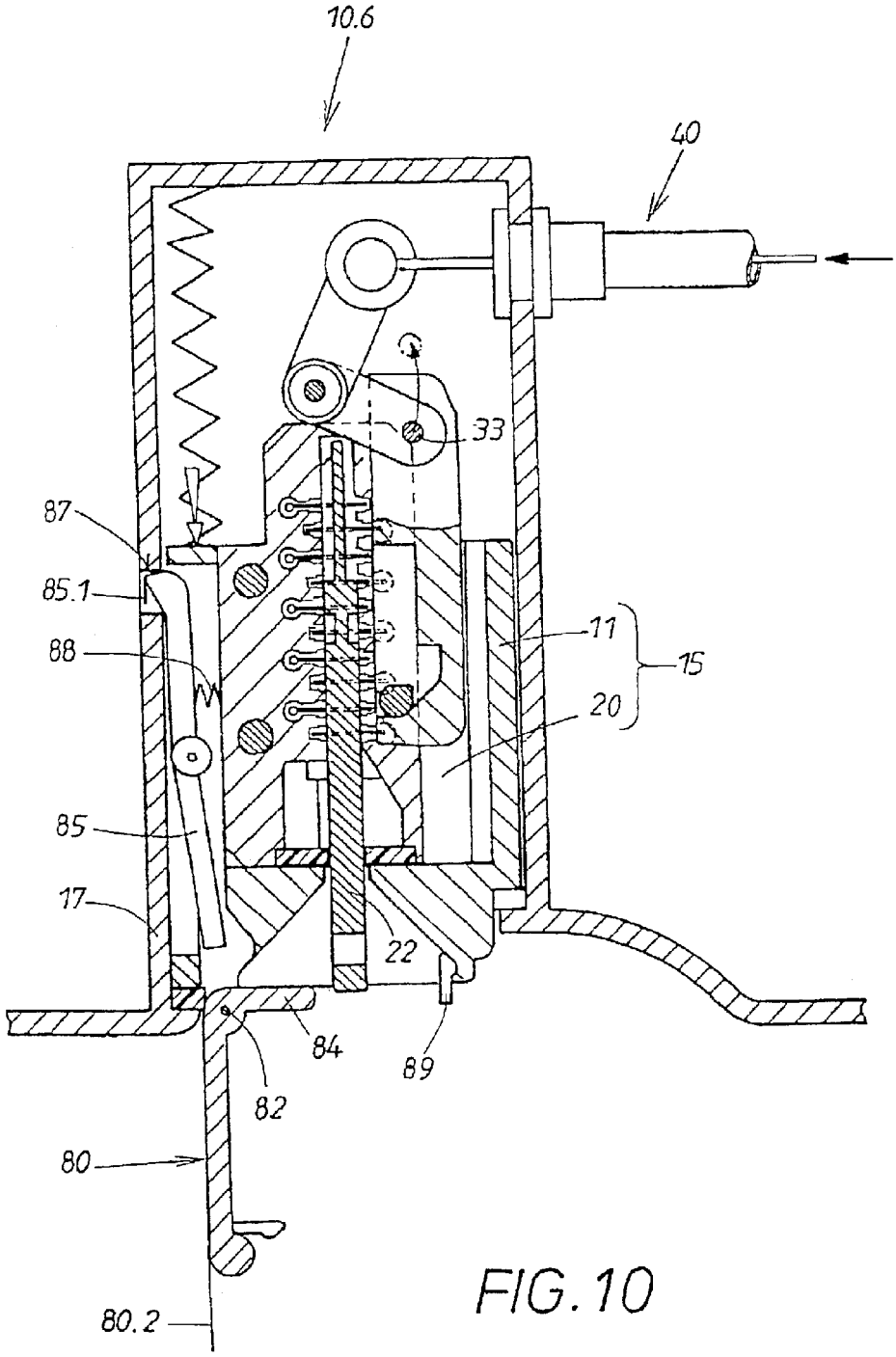
FIG. 10 shows the device according to FIG. 9 after a component, namely a hinged cover, is in its open position and thus blocks the use of the push button.

FIGS. 9 and 10 show a sixth embodiment of the device 10.6 according to the invention, which is the same in many respects as the device 10.5 of FIG. 7. The previous description applies insofar as agreement is present. It is sufficient to discuss the differences.

In the case of the device 10.6 shown in FIGS. 9 and 10, the push button 11 of the actuating unit 15 is made up of two parts: it has a cover 80, which serves as the contact surface 58 for the pushing actuation 12, and a sleeve part 93 with an expanded floor section 94. The lock cylinder 20 is supported by its end surface against the inside surface 81 of the floor section 94. In this area, it is also possible to provide an elastomeric seal 95 for the key channel 26. The cover 80 is designed as hinged lid and is supported at 82 in front of the floor section 94 of the sleeve 11. The hinged lid 80 can be pivoted in the direction of the arrow 83 between the covering position 80.1 shown in FIG. 9 and an open position 80.2 shown in FIG. 10.

A blocking lever 85 is able to move along with the actuating unit 15. The hinged cover 80 has a cam 84, which, when the cover swings 83, pivots the blocking lever 85 between two positions 85.2 and 85.1. When the cover 80 is moved into its open position 80.2 of FIG. 10, the cam 84 releases the blocking lever 85. Then, as a result of the restoring spring 88 acting on it, the blocking lever 85 can pivot into its blocking position 85.1, where it engages with a blocking shoulder 87 in the axial guide 17 of the actuating unit 15. The toggling movement 12 of the structural unit 15 is now blocked.

When the hinged cover 80 is in its covering position 80.1 of FIG. 9, its cam 84 presses the blocking lever 85 into its unblocking position 85.2, shown in FIG. 9. Then there is no effective blocking action between the actuating unit 15 and its axial guide 17. Now a toggling movement 12 of the actuating unit 15 is free to occur immediately, and this leads to the reverse actuation of the lock via the input element 40, previously described several times.

The floor section 94 of the actuating unit 15 accepts the end of the inserted key 22. When in its covering position 80.1, the hinged cover 80 therefore extends over the exposed end of the key. Now the previously mentioned contact surface 58 of the actuating unit 15 is available to be pushed. The cover can be secured in its closed position 80.1 by latching means 89, provided between the free end of the hinged cover 80 and the floor section 94 of the actuating unit 15.

List of Reference Nos.

10.1 first exemplary embodiment of the device (FIGS. 1–3*b*)
10.2 second exemplary embodiment of the device (FIGS. 4*a*, 4*b*)
10.3 third exemplary embodiment of the device (FIG. 5)
10.4 fourth exemplary embodiment of the device (FIGS. 6*a*, 6*b*)
10.5 fifth exemplary embodiment of the device (FIGS. 7, 8)
10.6 sixth exemplary embodiment of the device (FIGS. 9, 10)
11 push button
11.1 rest position of 11
11.2 intermediate position of 11
11.3 end position of 11; pushed-in position arrow of the toggling movement of 11 or 15, actuation by pressure
13 guide strip for 32 (FIGS. 4*a*, 4*b*)

14 insertion movement of 22 (FIG. 1)
15 actuating unit consisting of 11 and 20 (FIG. 1)
16 carrier for 20 (FIG. 5)
17 axial guide in 16 for 11 (FIG. 5)
18 restoring force for 11 or 15 (FIG. 1)
19 restoring spring for 18 or 90 (FIGS. 1, 5)
20 lock cylinder
21 tumbler, first row
21' tumbler, second row
21.1 blocking position of 21
21.2 release position of 21
22 key
23 axial plane through 20, arrangement of 21 and 21' in 20 (FIG. 1)
23.1 distance between 30 and 23 in position 11.1 (FIG. 4*a*)
23.2 distance between 30 and 23 in position 11.2 or 11.3 (FIG. 4*b*)
25 key channel in 20 (FIGS. 1, 9)
26 channel opening (FIG. 9)
27 stationary projection on 16 (FIG. 1)
28 projecting end of 21 (FIG. 3*a*)
28' projecting end of 21' (FIG. 3*a*)
29 noncircular profile of 20, rectangular profile (FIG. 3*a*)
30 first blocking edge for 21 (FIGS. 1, 3*a*)
30' second blocking edge for 21' (FIG. 3*a*)
30.1 rest position of 30 (FIGS. 1, 4*a*)
30.2 working position of 30 (FIGS. 1, 4*b*)
31 pivoting element (FIGS. 1, 6*a*)
32 thrust element (FIG. 4*a*)
33 bearing journal, pivot bearing for 31 (FIGS. 1, 6*a*)
33.1 position of 33 in 11.1 (FIGS. 1, 6*a*)
33.3 position of 33 in 11.3 (FIGS. 1, 6*a*)
34 control slide (FIG. 4*a*)
35 transverse movement of 30, 32 (FIGS. 1, 4*b*)
36 parallel displacement of 32, 30 (FIG. 4*a*)
37 C-shaped profile of 31, 32 (FIGS. 3*a*, 3*b*)
38, 38' sidepieces of 37
39 transverse load spring between 32 and 34 (FIG. 4*a*)
40 input element, Bowden cable
41 jacket of 40
42 core of 40
43 end stop on 11 or 15 (FIG. 1)
44 end stop on 16 (FIG. 1)
45 working arm on 31 (FIG. 1)
46 pivoting movement of 45 between 33.1 and 33.3 (FIG. 1)
47 support point of 45 on 27 (FIG. 1)
48 predetermined breaking point of 47 (FIG. 2)
49 end stop between 32 and 34 (FIG. 4*a*)
50 link guide (FIGS. 4*a*, 5)
51 stationary link part of 50, slide part
52 moving link part of 50, guide part
53 link end of 52 with the action of a stop (FIG. 4*a*)
54 longitudinal slot in 11 for 51 (FIG. 4*b*)
55 contact point on 32 (FIG. 4*a*)
56 opposing contact point for 55 on 57 (FIG. 4*a*)
57 reversing lever, transfer lever for 36 with respect to 41 (FIGS. 4*a*–7)
58 contact surface of 80 (FIG. 9)
59 maximum distance between 32 and 34 (FIG. 4*a*)
60 guide means in 31 (FIG. 6*a*)
61 starting phase of 12 (FIG. 4*b*)
62 remaining phase of 12 (FIG. 4*b*)
63 stationary bearing for 57 on 16 (FIG. 4*a*)
64 free space on 57 for 55 (FIG. 4*a*)
65 control pin of 60 (FIG. 6*b*), component piece of the pin (FIG. 8)
66 pin guide of 60 on 65 (FIG. 6*b*)
67 control curve for 65 in 66 (FIG. 6*b*)
68 driver shoulder in 66 (FIG. 6*b*)
69 free-travel section in 66 for 65 (FIGS. 6*a*, 6*b*)
70 total toggling stroke for 11, 15 consisting of 71 and 72 (FIG. 6*b*)
71 starting phase of 12 (FIG. 6*a*)
72 remaining phase of 12 (FIG. 6*b*)
73 pivoting movement of 31 (FIG. 6*a*)
74 axial movement of 31 (FIGS. 6*a*, 6*b*)
75 spring-loading of 31 versus 57 (FIG. 6*a*)
76 sidepiece spring for 75
77 opening in 66 (FIG. 6*a*)
78 groove in 66 (FIGS. 7, 8)
79 fastening means for 20 on 11 (FIG. 7)
80 hinged cover (FIGS. 9, 10)
80.1 covering position of 80
80.2 open position of 80
81 inside surface of 94 (FIG. 9)
82 pivot bearing for 80
83 arrow of the swinging movement of 80 (FIG. 9)
84 cam on 80 for 65 (FIGS. 9, 10)
85 blocking lever (FIGS. 9, 10)
85.1 blocking position of 85 (FIG. 10)
85.2 unblocking position of 85 (FIG. 9)
86 arrow of the pivoting movement of 85 (FIG. 9)
87 blocking shoulder on 16 (FIG. 9)
88 restoring spring for 85 (FIG. 10)
89 latching means between 80 and 11
90 cradle for 34, 32 (FIG. 5)
91 stop flange on 11 (FIG. 5)
92 front housing wall of 16 (FIG. 5)
93 sleeve part of 11 (FIG. 9)
94 floor section of 11 (FIG. 9)
95 elastomeric seal at 26 (FIG. 9)

What is claimed is:

1. Device (10.1–10.6) with an axially toggling push button (11) for actuating a lock on a door or flap, especially for a vehicle, with a lock cylinder (20), which has radially movable tumblers (21) in an axial arrangement (23) and to which a key (22) is assigned;

where the tumblers (21) are normally in a blocking position (21.1), in which the tumblers (21) project out of the lock cylinder (20);

but where the insertion of the key (22) into the lock cylinder (20) causes the tumblers (21) to move into the lock cylinder (20), so that they are then in their release position (21.2); and with a blocking edge (30), located on the side, next to the projecting tumblers (21), which edge cooperates with the tumblers (21) only in the blocking position (21.1), but not in the release position (21.2), and where the toggling movement (12) of the push button (11) can be transferred to an input element (40) of the lock only when the tumblers (21) are in their release position (21.2), wherein the lock cylinder is mounted so that it cannot rotate; wherein the blocking edge (30) can move transversely (35) relative to the axial arrangement (23) of the tumblers (21); wherein the transverse movement (35) proceeds from the toggling movement (12) of the push button (11); wherein, when the tumblers (21) are in their blocking position (21.1), they prevent the transverse movement (35) of the blocking edge (30) but allow such movement when they are in their release position (21.2); and wherein the toggling movement (12) of the push button (11) is transmitted to the input element (40) of the lock only during the simultaneous transverse movement (35) of the blocking edge (30).

2. Device (10.1, 10.4) according to claim 1, wherein the blocking edge (30) is on a pivoting element (31), which is pivotably supported (33) and thus able to pivot with respect to the axial plane (23).

3. Device (10.2, 10.3) according to claim 1, wherein the blocking edge (30) is on a thrust element (32), which is guided in a distance-variable manner (24.1, 24.2) with respect to the axial plane (23).

4. Device (10.2, 10.3) according to claim 3, wherein, upon actuation (12) of the push button (11), the thrust element (32) moves at least to a certain extent both parallel (36) and transversely (35) to the axial plane (23).

5. Device (10.1, 10.2, 10.4, 10.5) according to claim 1, wherein the lock cylinder (20) is installed in the push button (11) and forms with it a common toggling (12) actuating unit (15).

6. Device (10.3) according to claim 1, wherein the lock cylinder (20) is seated on a stationary carrier (16) independently of the push button (11) and does not move in concert with the toggling movement (12).

7. Device (10.3) according to claim 6, wherein the axial guidance (17) of the push button (11) and the mounting of the lock cylinder (20) are both accomplished in the same carrier (16).

8. Device (10.1-10.6) according to claim 1, wherein the lock cylinder (20) is noncircular (29) and is mounted nonrotatably on a carrier (16) or on the push button (11).

9. Device (10.1) according to claim 3, wherein the tumblers emerge (28, 28') from the lock cylinder (20) on diametrically opposing sides in two rows (21, 21'); wherein thrust element (32) has a C-shaped profile (37) and a pair of blocking edges (30, 30') on the ends (38, 38') of its two sidepieces; and wherein, upon actuation (12) of the push button (11) or of an actuating unit (15), these two blocking edges (30, 30') scan the two rows (21, 21') of tumblers to see if they are in their completely released position (21.2).

10. Device (10.1–10.6) according to claim 9, wherein the push button (11) or the actuating unit (15) is spring-loaded (19) by a restoring force (18) and is held in a defined rest position (11.1) by end stops (43, 44).

11. Device (10.1) according to claim 1, wherein a pivoting element (31) is pivotably supported (33) on the push button (11) or on an actuating unit (15).

12. Device (10.1) according to claim 11, wherein the pivoting element (31) is nonrotatably connected to a working arm (45), which transmits the pivoting movement (46) to the input element (40) of the lock.

13. Device (10.1) according to claim 11, wherein a spring (19) holds the blocking edge (30) in a rest position (30.1), where the blocking edge (30) or the blocking edges (30, 30') assume a position essentially parallel to an axial plane (23) passing through the lock cylinder.

14. Device (10.1) according to claim 13, wherein both the rest position (30.1) of the blocking edges (30) and the restoring force (18) acting on the push button (11) or on the actuating unit (15) are produced by the same spring (19).

15. Device (10.1) according to claim 11, wherein, in the rest position (30.1), the pivoting element or its working arm (45) is supported on a stationary projection (27); wherein if at least one of the tumblers (21, 21') of the lock cylinder (20) is still in its blocking position (21.1), forcible actuations (12) of the push button (11) or of the actuating unit (15) are absorbed by this support (47, 27); and wherein the pivoting movement (35, 46) of the pivoting element (31) or of its working arm (45) occurring in the release position (21.2) of the tumblers (21, 21') is directed away from this projection (27).

16. Device (10.1) according to claim 15, wherein the support point (47) on the pivoting element (31) or on the working arm (45) has a predetermined breaking point (48), which breaks during the course of forcible actuations (12).

17. Device (10.2, 10.3) according to claim 3, wherein the transverse movement (35) of the thrust element (32) is produced by a link guide (50) extending at an angle to the actuation direction (12); wherein the link guide (50) consists of two complementary link parts (51, 52), namely, a guide part (52) and a slide part (51), which fit into each other; and wherein the one link part (51) is stationary, whereas the other link part (52) is able to toggle along with the thrust element (32).

18. Device (10.2, 10.3) according to claim 17, wherein not only the thrust element (32) but also a control slide (34) are guided (13) on the push button (11) so that they can move (12) together with it; wherein limited by end stops (49), a transverse load (39) which determines a maximum distance (59) acts between the thrust element (32) and the control slide (34); wherein the concomitantly toggling link part (52) is seated on the control slide (34), its movement being limited by the one end of the link (53), which acts as a stop; wherein upon actuation (12) of the pushbutton (11) during the starting phase (61), the thrust element (32) continues to move transversely (35) under the action of the transverse load (39) and the link guide (50) of the control slide (34) until the end (53) of the link acts as a stop; and wherein during a remaining phase (62) of the toggling movement (12), the thrust element (32) moves exclusively in a direction parallel (36) to the axial plane (23) of the lock cylinder (20) and transfers this axial movement (36) to the input element (40) of the lock.

19. Device (10.2, 10.3) according to claim 17, wherein the thrust element (32) has an axial contact point (55) to which an opposing contact point (56) on a transfer lever (57) is assigned; and wherein the transfer lever (57) is pivotably supported (63) in a permanent position upline of the input element (40) of the lock.

20. Device according to claim 19, wherein the transfer lever (57) has a free space (64) next to its opposing contact point (56); and wherein this free space (64) is aligned with the contact point (55) of the thrust element (32) when the push button (11) is in its rest position (11.1).

21. Device (10.2, 10.3) according to claim 20, wherein, when the tumblers (21) are in the blocking position (21.1), the axial alignment of the contact point (55) of the thrust element (32) with the free space (64) of the transfer lever (57) allows a freedom of travel which renders the actuation (12) of the push button (11) or of an actuating unit (15) ineffective.

22. Device (10.4, 10.5) according to claim 1, wherein a pivoting element (31) is hinged to a transfer lever (57), which is supported (63) in a permanent position upline of the input element (40) of the lock; wherein the pivoting element has guide means (60), which hold the pivoting element (31) pivoted (73) against the tumblers (21) during the starting phase (71) of the toggling movement (12) of the push button (11) or an actuating unit (15) only until all the tumblers (21) have been scanned by the blocking edge (30); and wherein during the remaining phase (72) of the overall toggling movement (70), the guide means (60) ensure that the further movement (74) of the pivoting element (31) is essentially axial and parallel to itself.

23. Device (10.4, 10.5) according to claim 22, wherein the guide means (60) consist of a control pin (65), which moves along with the push button (11) or the actuating unit (15), and a profiled pin guide (66) on the pivoting element (31); wherein the pin guide (66) consists of a control curve (67), a driver shoulder (68), and a free-travel section (69) for the control pin (65); wherein the control curve (67) cooperates with the control pin (65) during the starting phase (71) of the overall toggling movement (70) to pivot the pivoting element (31) until the driver shoulder (68) is axially aligned with the control pin (65), and during the remaining phase (72) of the actuation (12) of the push button (11) or of the actuating unit (15) transmits to the pivoting element (31); and wherein, when the push button (11) or the actuating unit (15) is in the rest position (11.1), the control pin (65) is axially aligned with the free-travel section piece (69), where an actuation (12) of the push button (11) or of the actuating unit (15) while the tumblers (21) are in the blocking position (21.1) has no effect on the pivoting element (31).

24. Device (10.4, 10.5) according to claim 22, wherein an elastic force (75) acts on the pivoting element (31), which force tries to push the blocking edge (30) of the pivoting element (31) against the tumblers (21) when they are in their blocking position (21.1).

25. Device (10.4) according to claim 23, wherein the profiled pin guide (66) consists of an opening (77) in the pivoting element (31).

26. Device (10.5) according to claim 23, wherein the profiled pin guide (66) consists of a groove (78) in the pivot element (31).

27. Device (10.6) according to claim 1, wherein a hinged cover (80) is located in front of the end surface of the lock cylinder (20); and wherein the hinged cover (80) can swing (83) back and forth between a covering position (80.1) and an open position (80.2) with respect to a channel opening (26) serving to allow the insertion (14) of the key (22) into a key channel (25) of the lock cylinder (20).

28. Device (10.6) according to claim 27, wherein a blocking lever (85) is hinged (82) to the push button (11) or actuating unit (15); wherein the hinged cover (80) has a cam (84), which pivots (86) the blocking lever (85) between two positions (85.1, 85.2), namely, an effective blocking position (85.1) when the cover (80) is in the open position (80.2), where the blocking lever (85) engages with a stationary blocking shoulder (87) and thus prevents a movement (12) of the push button (11) or actuating unit (15); and an unblocking position (85.2), in which the blocking lever (85) is disengaged from the blocking shoulder (87) and allows a toggling movement (12) of the push button (11) or actuating unit (15).

29. Device (10.6) according to claim 28, wherein when the hinged cover (80) is in its covering position (80.1), it extends over the exposed end of the inserted key (22) and forms a contact surface (58) for the actuation (12) of the push button (11) or actuating unit (15).

30. Device (10.6) according to claim 28, wherein the blocking lever (85) is subjected to the force of a restoring spring (88) acting in the direction of the effective blocking position (85.1), that is, to a force which tries to engage the lever with the blocking shoulder (87) assigned to it.

31. Device (10.6) according to claim 27, wherein the hinged cover (80) is held in its covering position (80.1) by latching means (89).

* * * * *